US005081905A

United States Patent [19]

Yagyu et al.

[11] Patent Number: 5,081,905

[45] Date of Patent: Jan. 21, 1992

[54] HYDRAULIC PILOT OPERATION CIRCUIT AND VALVE FOR QUICKLY DISCHARGING OIL

[75] Inventors: Takashi Yagyu; Soutarou Tanaka, both of Ushiku; Kimio Katsuki, Ibaragi, all of Japan

[73] Assignee: Hitachi Construction Machinery Co., Ltd., Tokyo, Japan

[21] Appl. No.: 265,457

[22] PCT Filed: Feb. 18, 1988

[86] PCT No.: PCT/JP88/00166

§ 371 Date: Oct. 17, 1988

§ 102(e) Date: Oct. 17, 1988

[87] PCT Pub. No.: WO88/06241

PCT Pub. Date: Aug. 25, 1988

[30] Foreign Application Priority Data

Feb. 20, 1987 [JP] Japan ..... 62-23787[U]
Feb. 26, 1987 [JP] Japan ..... 62-27682[U]

[51] Int. Cl.[5] ..... F15B 11/08

[52] U.S. Cl. ..... 91/461; 91/433; 137/102; 137/625.6; 137/625.64

[58] Field of Search ..... 91/304, 461, 442, 468, 91/433, 459; 137/102, 625.6, 625.64

[56] References Cited

U.S. PATENT DOCUMENTS

| | | | |
|---|---|---|---|
| 2,816,563 | 12/1957 | Pappas | 137/102 |
| 3,025,869 | 3/1962 | Kenfield | 137/102 X |
| 3,734,258 | 5/1973 | Roob | 137/102 X |
| 3,748,967 | 7/1973 | Richter et al. | 91/461 X |
| 3,978,666 | 9/1976 | Kelly et al. | 60/468 X |
| 4,002,374 | 1/1977 | Horowitz | 137/102 X |
| 4,524,803 | 6/1985 | Stoll et al. | 137/625.64 |
| 4,574,687 | 3/1986 | Kauss et al. | 91/461 |
| 4,615,353 | 10/1986 | McKee | 137/102 |
| 4,663,936 | 5/1987 | Morgan | 60/468 X |
| 4,753,158 | 6/1988 | Hirata et al. | 91/461 |

FOREIGN PATENT DOCUMENTS

| | | | |
|---|---|---|---|
| 152989 | 11/1977 | Japan . | |
| 144302 | 9/1982 | Japan | 91/461 |
| 11704 | 1/1985 | Japan . | |
| 03685 | 12/1984 | PCT Int'l Appl. | 91/461 |

*Primary Examiner*—Edward K. Look
*Assistant Examiner*—George Kapsalas
*Attorney, Agent, or Firm*—Oliff & Berridge

[57] ABSTRACT

A hydraulic control valve is controlled and changed over by a hydraulic pressure output from a remote control valve. A change-over valve is provided between an output port of the remote control valve and a pilot port of the hydraulic control valve. The change-over valve connects the output port of the remote control valve to the pilot port of the hydraulic control valve when the remote control valve is operated, and it connects the pilot port of the hydraulic control valve to a tank when the remote control valve is set to the neutral position. The change-over valve comprises a hydraulic change-over valve capable of establishing the above states of connection by the hydraulic pressure output from the remote control valve, or an electromagnetic change-over valve capable of establishing the above states of connection by electrically detecting the operation of the remote control valve.

8 Claims, 4 Drawing Sheets

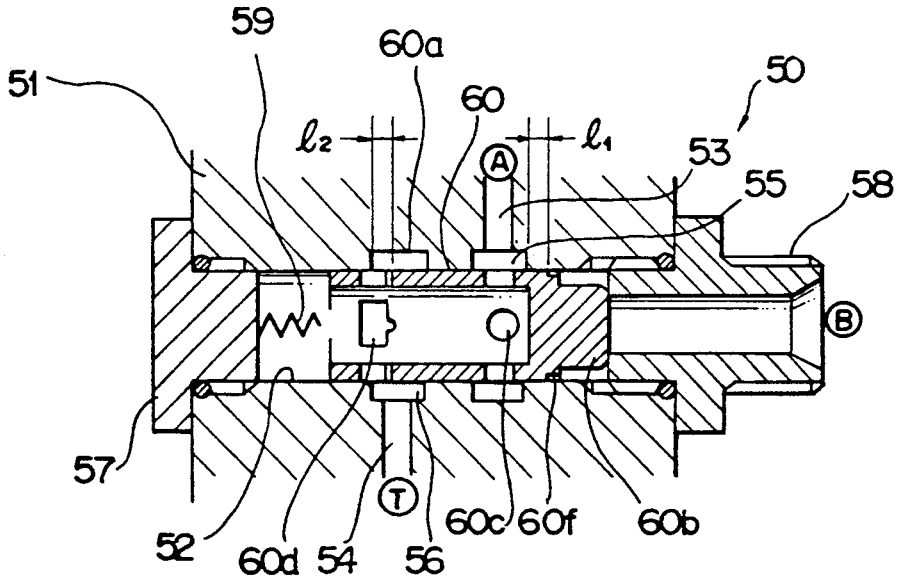
FIG. 2B
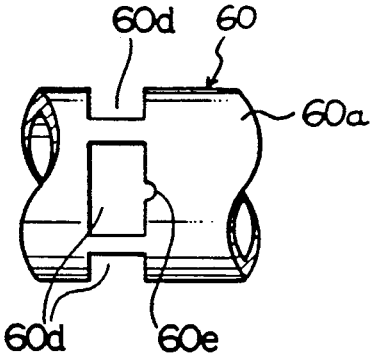
FIG. 2C
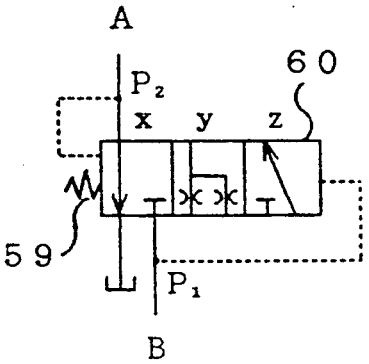

PRIOR ART

HYDRAULIC PILOT OPERATION CIRCUIT AND VALVE FOR QUICKLY DISCHARGING OIL

BACKGROUND OF THE INVENTION

1. Field of the Invention

This invention relates to a hydraulic pilot operation circuit for remote-controlling, by means of a hydraulic pilot pressure output from a remote control valve, a hydraulic control valve which controls the operation of driving a hydraulic actuator for use in a construction machine such as a hydraulic power shovel. The present invention also relates to a valve for quickly discharging an oil (referred to as a hydraulic pressure quick discharge valve hereinafter) suitable for improving the change-over response of the hydraulic control valve, the hydraulic pressure quick discharge valve being disposed, for example, in a line which connects the remote control valve and a pilot port of the hydraulic control valve to each other.

2. Description of the Prior Art

FIG. 4 shows a conventional hydraulic pilot operation circuit for controlling a change-over of a directional control valve which is a hydraulic control valve, by a hydraulic pressure supplied from a remote control valve.

When an operation lever 1 is operated so as to be turned in a direction R as viewed in FIG. 4, the pressure of oil ejected from a hydraulic pump 2 for operating-system is reduced at a rate in proportion to the amount of operation of a remote control valve 3, introduced via a line 4 to a pilot port 5*a* of a directional control valve 5 which is changed over by a hydraulic pilot pressure, so that the directional control valve 5 is changed from a position B (neutral position) to a position A. As a result, pressurized oil is supplied from a hydraulic pump 6 for cylinder driving system to a rod chamber of a hydraulic cylinder 7 so that a piston rod 7*a* retracts. When the operation lever 1 is returned to the neutral position while the directional control valve 5 is maintained at the position A after changing-over thereto, the line 4 communicates with a tank 9 via the remote control valve 3 and a line 8. The directional control valve 5 is changed to the position B by a force of a return spring 5*c*, thereby stopping the movement of the piston rod 7*a*. During this sequence of operations, the other pilot port 5*b* of the directional control valve 5 communicates with the tank via a line 10, a remote control valve 11, and the line 8. When the operation lever 1 is turned in a direction L, each component operates as described above, thereby extending the piston rod 7*a*.

If the hydraulic pilot operation circuit shown in FIG. 4 is applied to a large sized construction machine, the length of each of the lines 4 and 10 connecting the remote control valves 3 and 11 to the pilot ports 5*a* and 5*b* of the directional control valve 5 is increased, so that the resistance to an oil flowing through each of the lines 4 and 10 increases. There is therefore a possibility of occurrence of a response retardation in returning of the directional control valve 5 to the neutral position from the position A or C.

If the operation lever 1 is gradually returned to the neutral position, the directional control valve 5 is gradually changed to the neutral position generally in response to change in the pressure output from the remote control valve 3 or 11. In this case, there is no problem in terms of response retardation. If the operation lever 1 is rapidly operated when returned to the neutral position, returning of the directional control valve 5 to the neutral position is retarded. That is, the pressure output from the remote control valve 3 abruptly decreases to the tank pressure in response to an abrupt operation of the operation lever 1, so that the directional control valve 5 starts returning to the neutral position by a force of a return spring 5*c*. During returning of the directional control valve 5 to the neutral position, oil is discharged from the pilot port 5*a* (5*b*) into the line 4 (10) as a spool of the directional control valve 5 moves, and this oil flows to the tank via the remote control valve 3 (11) and the line 8. If the resistance to the oil flowing through the line 4 (10) undesirably increases due to increase of the length of the line 4(10) as described above, returning of the directional control valve 5 to the neutral position is delayed from returning of the operation lever 1 to the neutral position, thus deteriorating response characteristics.

When the directional control valve 5 is changed from the neutral position to the position A (C), oil which is discharged from the pilot port 5*b* (5*a*) of the directional control valve 5 into the line 10 (4) in response to the movement of the spool flows to the tank via the remote control valve 11 (3) and the line 8. Therefore, changing over the directional control valve 5 from the neutral position to the position A (C) is retarded even if the operation lever 1 is rapidly operated so as to be changed from the neutral position to the desired operative position. Thus, there is a problem of the directional control valve 5 of not being changed over in compliance with operation of the operation lever 1. The problem of response retardation relating to these two operations is considerable especially in a cold district. It is desirable to improve response characteristics in changing-over the directional control valve 5.

SUMMARY OF THE INVENTION

It is an object of the present invention to provide a hydraulic pilot operation circuit adapted to improve change-over characteristics of a hydraulic control valve which is remote-controlled by means of a hydraulic pilot pressure.

It is another object of the present invention to provide a hydraulic pressure quick discharge valve suitable for use in a line provided between a remote control valve and a hydraulic control valve which is changed over by the hydraulic pressure supplied from the remote control valve.

The present invention is applied to a hydraulic pilot operation circuit in which a hydraulic control valve disposed between a hydraulic pressure source and a hydraulic actuator and adapted to control the flow rate and/or the direction of oil supplied to the hydraulic actuator is changed over by a hydraulic pilot pressure which is supplied from a remote control valve to a pilot port of the hydraulic control valve. A change-over means for improving change-over response of the hydraulic control valve is provided between an output port of the remote control valve and the pilot port of the hydraulic control valve.

The change-over means connects the output port of the remote control valve to the pilot port of the hydraulic control valve when the remote control valve is operated, and connects the pilot port to a tank when the remote control valve is operated to a neutral position.

A hydraulic change-over valve capable of being changed by a hydraulic pressure output from the remote control valve to change-over positions to establish the above two states of connection may be employed as the change-over means.

It is preferable to employ, as the hydraulic change-over valve, a hydraulic pressure quick discharge valve which has: an inlet port supplied with a hydraulic pressure; an outlet port through which a hydraulic pressure is output corresponding to the hydraulic pressure supplied to the inlet port; a tank port which provides a communication between the outlet port and the tank; a plunger capable of moving between a first position at which it isolates the inlet port and the outlet port from each other and provides a communication between the outlet port and the tank port and a second position at which it provides a communication between the inlet port and the outlet port and isolates the outlet port and the tank port from each other; and a resilience means for ordinarily urging the plunger to be displaced toward the first position, and in which: when a hydraulic pressure prevailing over a resilient force of the resilience means is supplied to the inlet port, the plunger is moved by the output hydraulic pressure to a third position, which is determined in accordance with the hydraulic pressure, between the first and second positions, so that a hydraulic pressure lower than the hydraulic pressure at the inlet port by a value corresponding to the resilient force of the resilience means is output from the outlet port; and, when the supply of hydraulic pressure to the inlet port is cut, the plunger is moved by the resilient force of the resilience means to the first position, so that the outlet port communicates with the tank port.

Also, an electromagnetic change-over valve capable of being changed over by an electromagnetic force may be employed as the change-over means while a detection means for detecting a neutral state of the remote control valve as an electrical signal is provided. The electromagnetic change over valve is changed over between a first position at which it connects the output port of the remote control valve to the pilot port of the hydraulic control valve when the detection means does not detect the neutral state of the remote control valve and a second position at which it connects the pilot port to the tank when the detection means detects the neutral state of the remote control valve.

In case the hydraulic control valve is a two-position-changeover valve which has one pilot port and is changed over by one remote control valve, one change-over means is provided between the remote control valve and the pilot port.

In case the hydraulic control valve is a three-position-changeover valve which has a pair of pilot ports and is changed over by a pair of remote control valves, said change-over means is provided between each of the pair of remote control valves and corresponding one of the pair of pilot ports.

Preferably, the hydraulic change-over valve or electromagnetic valve provided as the change-over means is directly attached to the pilot port of the hydraulic control valve in order to minimize the length of the return line.

The operation of this circuit will be described below.

A pressurized oil is output by the operation of the remote control valve, and the change-over means is changed over by the pressurized oil so that a hydraulic pressure is introduced to the pilot port of the hydraulic control valve. The hydraulic control valve is thereby changed from the neutral position to an operative position. During this operation, in case the hydraulic control valve is a three-position-changeover valve, oil flows from one of the pilot ports, to which the pressurized oil is not applied, to the tank via a return line and the change-over means. Only if said change-over means is provided between the pilot port and the remote control valve, the length of the return line can be shortened and the fluid resistance of the oil flow through the return line can be reduced as compared with the conventional circuit. Therefore, the hydraulic control valve is rapidly changed to the operative position. When the remote control valve is operated to the neutral position from the operative position, the change-over means is changed to the original position, so that the oil at the pilot port to which the hydraulic pressure is applied returns to the tank via the return line and said change-over means and the hydraulic control valve is changed to the neutral position. The length of the return line formed at this time can be shortened as compared with the conventional circuit, and the hydraulic control valve is rapidly changed over.

In consequence, the length of the return line that connects the pilot port to the tank at the time when said hydraulic control valve is changed over is smaller than that in the conventional circuit. The change-over response of the hydraulic control valve to the operation of the remote control valve is thereby improved.

The hydraulic pressure quick discharge valve operates as described below.

When a pressurized oil prevailing over the resilience means is supplied to the inlet port of the hydraulic pressure quick discharge valve, the plunger is moved to the second or third position, thereby outputting pressurized oil through the outlet port in accordance with the oil pressure of said inlet port. At this time, the oil pressure thereof is reduced by a value corresponding to the force of said resilience means. When the supply of pressurized oil to the inlet port is cut, the plunger is moved to the first position by said force of the resilience means, so that the outlet port communicates with the tank port.

BRIEF DESCRIPTION OF THE DRAWINGS

FIG. 2A is a cross-sectional view of an example of the hydraulic pressure quick discharge valve shown in FIG. 1; hydraulic pressure quick discharge valve shown in FIG. 2A;

FIG. 2C is a diagram of a hydraulic pressure circuit equivalent to the hydraulic pressure quick discharge valve.

DETAILED DESCRIPTION OF THE PREFERRED EMBODIMENTS OF THE INVENTION

First Embodiment

Figure 4:
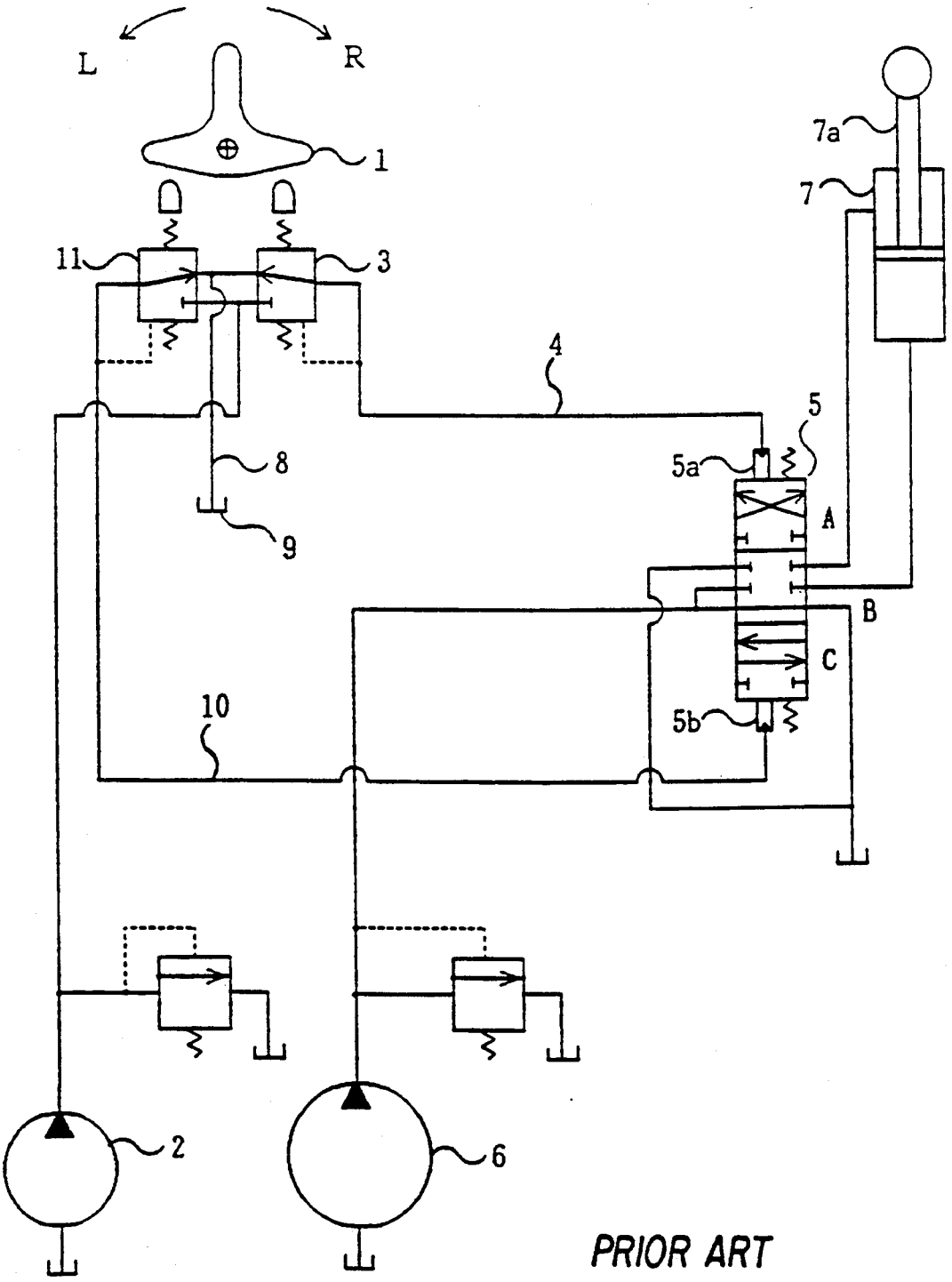
FIG. 4 is a diagram of a hydraulic pressure circuit of a conventional circuit corresponding to FIG. 1.

A first embodiment of the present invention will be described below with reference to FIG. 1. Components similar to those shown in FIG. 4 are indicated by the same reference characters.

Figure 1:
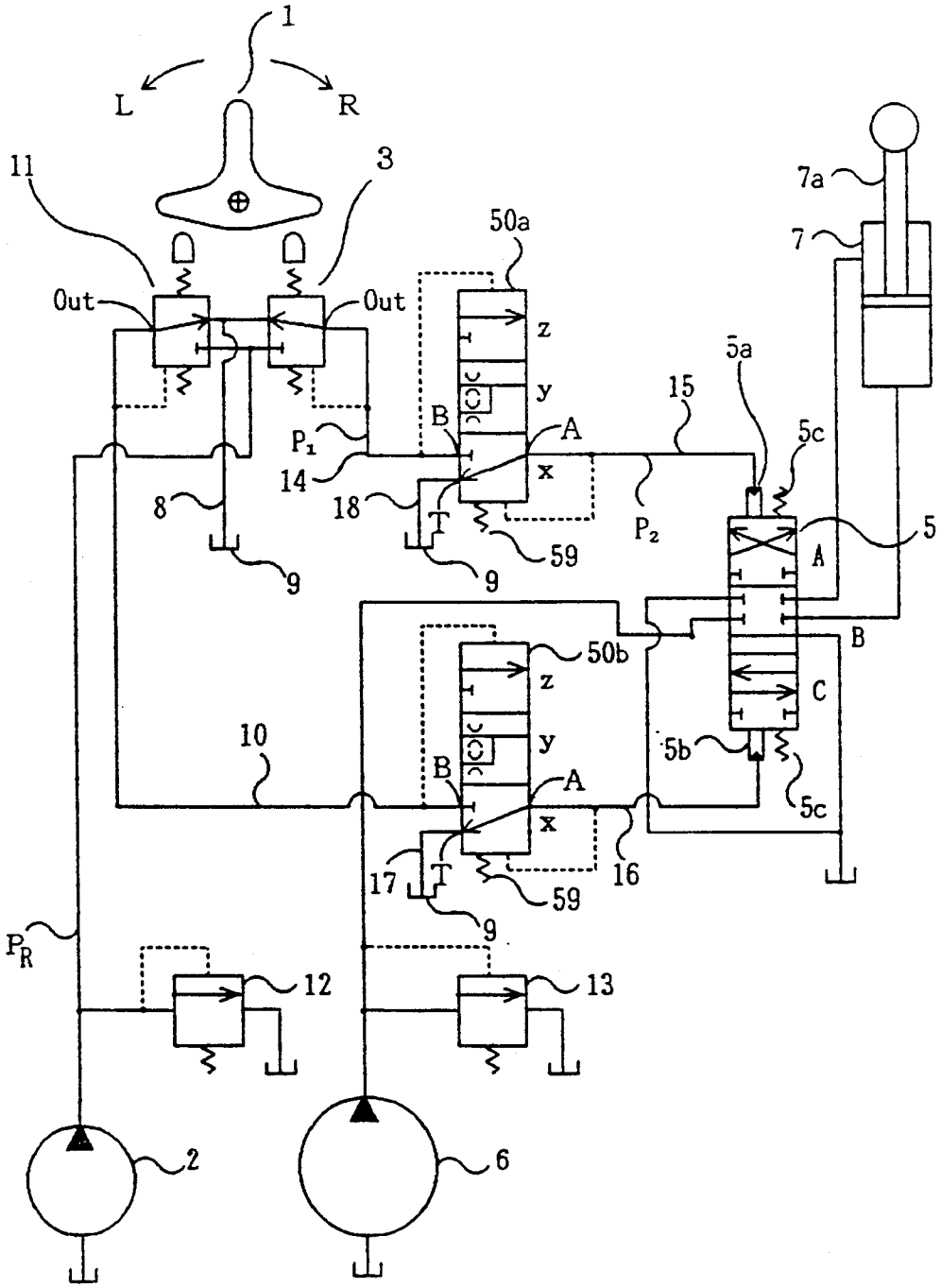
FIGS. 1 and 3 are diagrams of hydraulic pressure circuits of first and second embodiments of the present invention.

Referring to FIG. 1, a delivery port of a hydraulic pump 2 for an operating system is connected to pilot ports 5*a* and 5*b* of a directional control valve 5 via remote control valves 3 and 11 each of which is operated by an operation lever 1 so as to output a hydraulic pilot pressure. The directional control valve 5 is changed over from a position B to a position A or to a position C by the hydraulic pilot pressure output from the remote control valve 3 or 11. A hydraulic pressure quick discharge valve 50*a* such as that shown in FIGS. 2A to 2C interconnects the remote control valve 3 and the pilot port 5*a* while a hydraulic pressure quick discharge valve 50*b* interconnects the remote control valve 11 and the pilot port 5*b*. Ports A of the quick discharge valves 50*a* and 50*b* are respectively connected to the pilot ports 5*a* and 5*b* via lines 15 and 16; ports B of the quick discharge valves 50*a* and 50*b* are respectively connected to output ports Out of the remote control valves 3 and 11 via lines 14 and 10; and ports T of the quick discharge valves 50*a* and 50*b* are respectively connected to tanks 9 via lines 18 and 17. Preferably, the quick discharge valves 50*a* and 50*b* are disposed in the vicinity of the pilot ports 5*a* and 5*b* or are directly attached thereto.

Each of the quick discharge valves 50*a* and 50*b* is changed to positions y or z indicated in FIG. 1 by hydraulic pilot pressure output from the remote control valve 3 or 11 into the line 14 or 10. When the remote control valve 3 or 11 do not output the pilot pressure to the line 14 or 10, each of the quick discharge valves 50*a* and 50*b* is in position x, as shown in FIG. 1. A delivery port of a hydraulic pump 6 for cylinder driving system provided as a hydraulic pressure source is connected to a cylinder 7 which is a hydraulic actuator via the directional control valve 5 which is a hydraulic control valve. Maximum pressures of the hydraulic pumps 2 and 6 are respectively set by relief valves 12 and 13.

The quick discharge valves 50*a* and 50*b* will be described in detail with reference to FIGS. 2A to 2C.

A through hole 52 is bored in a valve body 51, a path 53 which provides communication between the through hole 52 and the port A and a path 54 which provides a communication between the through hole 52 and the tank port T are bored in the valve body 51 so that they are perpendicular to the through hole 52. Annular grooves 55 and 56 are respectively formed in the inner peripheral surface of the through hole 52 at the connections between the paths 53 and 54 and the through hole 52. One end of the through hole 52 is closed by a plug 57 screwed into the valve body 51. A hose adaptor 58 in which an oil passage is formed is screwed into the other end of the through hole 52. An inlet port of the hose adaptor 58 is used as the inlet port B of the quick discharge valve 50. A plunger 60 is disposed between the plug 57 and the adaptor 58 slidably in the axial direction of the through hole 52 while being urged by a spring 59 toward the adaptor 58.

The plunger 60 has a cylindrical body portion 60*a* and a seat portion 60*b* the diameter of which is smaller than that of the cylindrical body portion 60*a*. The cylindrical body portion 60*a* has four round holes 60*c* and four rectangular holes 60*d* formed in its peripheral wall. A notch 60*e* is formed with each of the rectangular holes 60*d*, as shown in FIG. 2B. While, as shown in FIG. 2A, the seat portion 60*b* of the plunger 60 is seated on the adaptor 58, the internal path of the plunger 60 communicates via the round holes 60*c* and the groove 55 with the path 53 that communicates with the outlet port A and, at the same time, the internal path of the plunger communicates via the rectangular holes 60*d* and the groove 56 with the path 54 that communicates with the tank port T, thereby providing communication between the port A and the tank port T. Notches 60*f* are formed at the connection portion of the cylindrical body portion 60*a* and the seat portion 60*b* so that there is a distance $l_1$ between the right-hand end of the groove 55 and the lefthand ends of the notches 60*f* and there is a distance $l_2$ ($\approx l_1$) between the left-hand end of the groove 56 and the right-hand ends of the notches 60*e*.

FIG. 2C shows hydraulic symbol representing the thus-constructed quick discharge valve 50. That is, no supply of any pressurized oil at the inlet port B or no supply of a pressurized oil beyond an initial pressure set by the spring 59 at the same causes the plunger 60 to be placed at the position x (first position as indicated in FIG. 2A); supply of a maximum pressure Pmax (maximum output pressure of the remote control valves 3 and 11) at the inlet port B causes the plunger 60 to be placed at the position z (second position); and supply of a pressure $P_1$ lower than the maximum pressure Pmax at the inlet port B causes the plunger 60 to be placed at the position y (third position). The action of the valve relating to these states will be described below in detail.

When the plunger 60 is moved against the spring 59 to the left as viewed in FIG. 2A for a distance greater than $l_1$ by the oil pressure $P_1$ lower than the maximum pressure Pmax and applied to the inlet port B, the inlet port B communicates with the outlet port A via the notches 60*f* and the groove 55 while the internal path of the cylindrical portion 60*a* is isolated by the peripheral wall from the groove 56 that communicates with the tank port T. Thus resulting in a flow of the pressurized oil supplied to the inlet port B from the path 53 to the outlet port A. Therefore, the pressurized oil supplied via the inlet port B is reduced at a rate corresponding to the resilience force of the spring 59 (e. g., 1 to 2 kg f/cm$^2$), so that an oil pressure $P_2$ lower than the oil pressure $P_1$ at the inlet port B is output from the outlet port A. The plunger 60 that is urged to the right by the resilience force of the spring 59 and also urged to the left by the oil pressure applied to the inlet port B is placed to the position y (third position) at which these urging forces balance with each other.

As the pressure Pmax or $P_1$ applied to the inlet port B gradually decreases, the equilibrium between the forces exerted on the plunger 60 to the left and right is destroyed, so that the plunger 60 moves to the right by the resilience force of the spring 59. In response to this rightward movement of the plunger 60, the groove 55 that communicates with the outlet port A via notches 60*f* is cut, and the rectangular holes 60*d* and the groove 56 communicating with the port T are connected to each other by the notches 60*e* so that the outlet port A communicates with the tank port T, thereby reducing the pressure at the outlet port A. When a differential pressure ($P_1-P_2$) between the oil pressure $P_1$ at the inlet port B and the oil pressure $P_2$ at the outlet port A exceeds a value corresponding to the resilience force of the spring 59, e. g., 1 to 2 kg f/cm$^2$, the plunger 60 starts moving again to the left against the resilience force of the spring 59 and the inlet port B and the outlet port A again communicate with each other via the notches 60*f*, the groove 55 and the path 53; and the internal path of the cylindrical body portion 60*a* is isolated by the peripheral wall thereof from the groove 56 communicating with the tank port T, so that the outlet port A and the tank port T are again isolated from each other, as described above. As this action is repeated, the pressure at the outlet port A gradually decreases in response to the reduction in the pressure at the inlet port B while maintaining the differential pressure between the pressures $P_1$ and $P_2$ at 1 to 2 kgf/cm$^2$ ($P_1 > p_2$).

If, while a connection of the inlet port B and the outlet port A causes the pressure $P_2$, which obtained by reducing the pressure $P_1$ at the inlet port B, to be output to the outlet port A, the inlet port B is connected to the tank via a certain line, the plunger 60 starts moving to the right by the resilience force of the spring 59 at a moment when $P_1 \approx p_2$ is accomplished because of reduction of the pressure $P_1$ applied to the inlet port B.

The plunger 60 moves until the seat portion 60*b* thereof abuts against the left end of the adaptor 58, as shown in FIG. 2A. The inlet port B and the outlet port A are thereby isolated from each other while the outlet port A and the tank port T communicate with each other, thereby immediately reducing the pressure $P_2$ at the outlet port A to the tank pressure. At this time, as shown in FIG. 2A, since the plunger 60 abuts against the left end of the adaptor 58, no oil is discharged from the inlet port B. Accordingly, when the inlet port B is connected to the tank via a certain line, no oil flows from the inlet port B to the tank, so that only the pressure at the inlet port B is conducted to the tank. In consequence, the quick discharge valve 50 is immediately changed from the position z or y to the position x and is maintained at this position. In short, if the pressure $P_1$ at the inlet port B decreases by a value corresponding to a differential pressure of 1 to 2 kgf/cm$^2$ relative to the pressure at the outlet port A when the inlet port B is communicated with the tank via a certain line, the outlet port A immediately communicates with the tank port T. The maximum pressure Pmax is sufficiently high as compared with 1 to 2 kgf/cm$^2$.

The operation of the hydraulic pilot operation circuit shown in FIG. 1 will now be described below.

When the operation lever 1 is turned in a direction R as indicated in FIG. 1, a pressure $P_R$ of oil delivered from the hydraulic pump 2 is reduced by the remote control valve 3, and an oil pressure in proportion to the amount of operation of the operation lever 1 is output in the line 14. When this oil pressure in the line 14 is represented by the above-mentioned pressure $P_1$ (<Pmax), the quick discharge valve 50 is changed over to the position y as described above. In consequence, the pressure at the outlet port A of the quick discharge valve 50*a* becomes the pressure $P_2$ reduced in accordance with the resilience force of the spring 59. The pressure $P_2$ is conducted to the pilot port 5*a* of the directional control valve 5 via the line 15. At this time, the other quick discharge valve 50*b* is at the change-over position x and the outlet port A and the tank port T of the quick discharge valve 50*b* communicate with each other. Therefore, the line 16 connected to the pilot port 5*b* of the directional control valve 5 is connected to the line 17 that connects the tank port T of the quick discharge valve 50*b* to the tank 9. The pilot port 5*b* is thereby connected to the tank 9 through a line length smaller than that in the conventional circuit, so that the resistance to an oil flow of the lines 16 and 17 becomes smaller than that of the lines 16 and 10. In consequence, even in a case where the pressure of oil output from the remote control valve 3 is increased by an abrupt operation of the operation lever 1 in order to change over the directional control valve 5 to the neutral position to the position A, the pressure drop of the oil flow discharged from the pilot port 5*b* into the line 16 and returned to the tank 9 via the line 17 in response to the change-over operation of the directional control valve 5 is smaller than that in the case of the conventional circuit. Accordingly, the directional control valve 5 is immediately changed over from the neutral position to the position A. This change-over of the directional control valve 5 rapidly responding to the operation of the operation lever 1 enables a rapid response, with respect to the operation lever 1, of the supply of pressurized oil from the hydraulic pump 6 to the rod chamber of the hydraulic cylinder 7 by way of the directional control valve 5. As a result, the piston rod 7*a* is retracted with improved response to the rapid operation of the operation lever 1.

When the operation lever 1 is returned to the neutral position under the condition where the directional control valve 5 is at the change-over position A, the quick discharge valve 50*a* changed to the position z or y is immediately changed over the position x at the moment when the pressure at its inlet port B becomes lower than the pressure at the outlet port A by 1 to 2 kg f/cm$^2$ or more. The line 15 connected to the pilot port 5*a* is thereby connected via the outlet port A and the tank port T of the quick discharge valve 50*a* to the line 18 connected to the tank 9. In consequence, the directional control valve 5 is changed from the position A to the neutral position. In response to this change-over operation of the directional control valve 5 to the neutral position, oil which is discharged from the pilot port 5*a* flows through the lines 15 and 18 and returns to the tank 9. The line length of the return lines 15 and 18 is smaller than that of the return line formed by the lines 15, 14 and 2 in the conventional manner, and the resistance to an oil flow through the return line is therefore smaller. Therefore, the fluid resistance of the oil discharged from the pilot port 5*a* after the change-over of the directional control valve 5 is smaller than that in the case of the conventional circuit. As a result, in response to the operation of rapidly returning the operation lever 1 to the neutral position, the directional control valve 5 is immediately changed from the position A to the position B, and the piston rod 7*a* which is retracting is thereby stopped immediately in response to the operation of neutralizing the operation lever 1.

Response characteristics of each element relative to the operation of the operation lever 1 when the operation lever 1 is turned in the direction L as indicated in FIG. 1 as well as response characteristics of each element when the operation lever 1 positioned at the side L is changed to the neutral are the same as described above.

On the other hand, if the operation lever 1 is gradually operated, the pressure output from the remote control valve 3 (11) changes also gradually. For instance, when the pressure of oil output from the remote control valve 3 is changed within a desired oil pressure range between the tank pressure and the maximum pressure Pmax of the quick discharge valve 50*a* (50*b*) by the operation of the operation lever 1, the quick discharge valve 50*a* (50*b*) is at the position y and a pressure is output at the port A of this valve which is obtained by reducing by 1 to 2 kg f/cm$^2$ the pressure output from the remote control valve 3 (11) in proportion to the amount of operation thereof and supplied to the port B. The directional control valve 5 is at the change-over position A or C in accordance with the pressure at the port A of the quick discharge valve 50*a* or 50*b* and, in this state, controls the flow rate at which pressurized oil is supplied to the cylinder 7. In short, if the oil pressure output from the remote control valve 3 (11) is lower than the maximum pressure Pmax of the quick discharge valve 50*a* (50*b*) mentioned above, the quick discharge valve 50*a* (50*b*) is at the position y and the oil pressure output from the remote control valve 3 (11) in proportion to the amount of operation of the operation lever 1 is supplied to the pilot port 5*a* (5*b*) of the directional control valve 5 via the quick discharge valve 50*a* (50*b*), thus operating the directional control valve 5 in a manner similar to that in the case of the conventional circuit.

Second Embodiment

A second embodiment of the present invention will be described below with reference to FIG. 3. Components or portions similar to or identical with those shown in FIG. 1 are indicated by the same reference characters, and only differences from FIG. 1 will be described.

Figure 3:
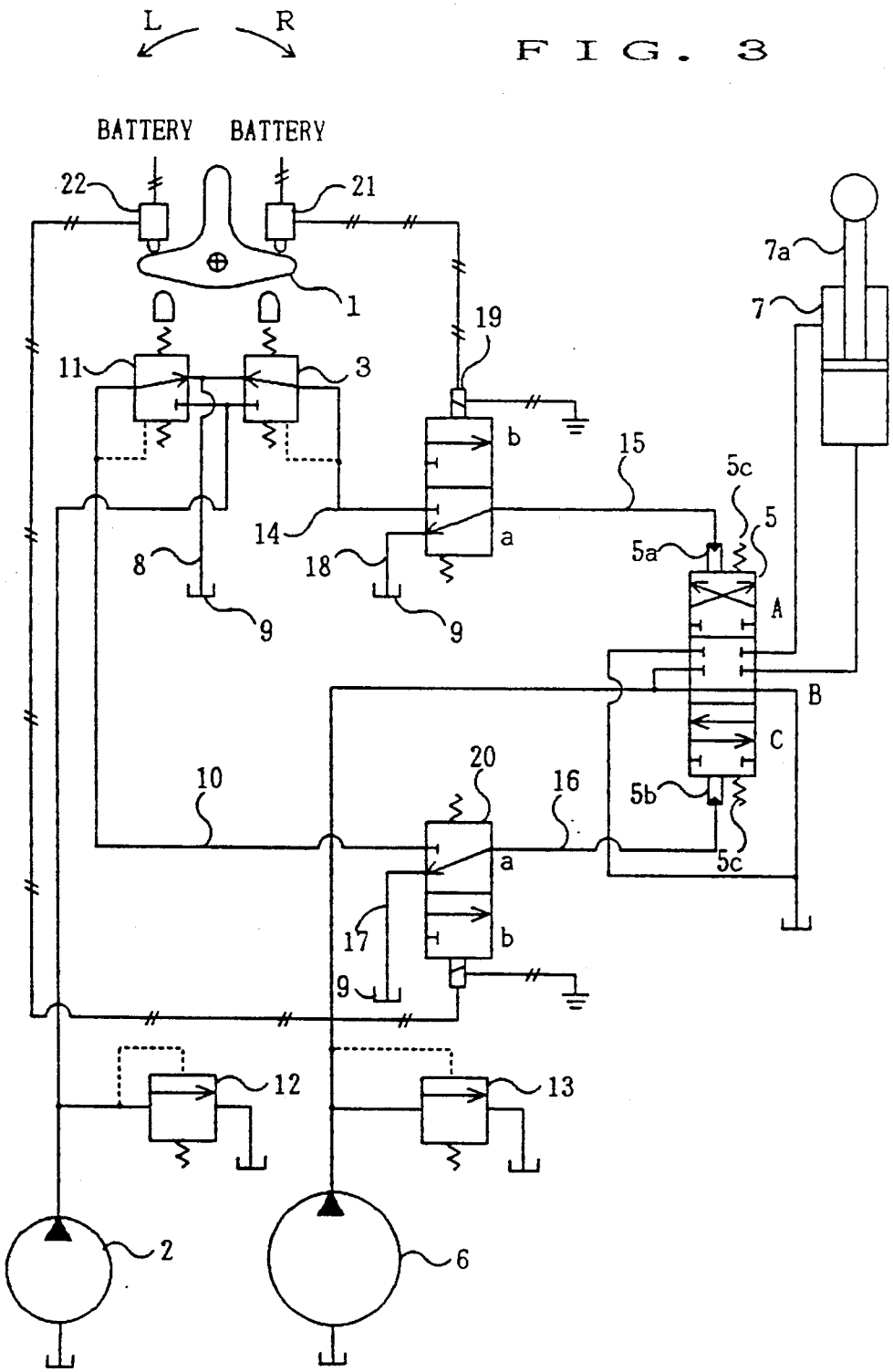

Referring to FIG. 3, a directional control valve 19 which is changed over by an electromagnetic force is interposed between the remote control valve 3 and the pilot port 5*a* of the directional control valve 5 changed over by a hydraulic pilot pressure, and a directional control valve 20 (hereinafter referred to as "electromagnetic valve") changed over by an electromagnetic force is interposed between the remote control valve 11 and the pilot port 5*b*. Limit switches 21 and 22 operate in association with the operation lever 1. Each of these limit switches 21 and 22 is in an off state when the operation lever 1 is at the neutral position, and it is turned on when the operation lever 1 is operated from the neutral position to the side R or L. Each of the electromagnetic valves 19 and 20 is changed to a position b when the limit switch 21 or 22 is turned on in a linked relationship with the operation of the operation lever 1.

The operation of this circuit will be described below.

When the operation lever 1 is turned in the direction R, the pressure of oil delivered from the hydraulic pump 2 is reduced by the remote control valve 3. At the same time, the limit switch 21 is turned on and the electromagnetic valve 19 is changed to the position b. The lines 14 and 15 are thereby connected to each other, and the pressure of oil output from the remote control valve 3 is supplied to the pilot port 5*a* of the directional control valve 5 via the lines 14 and 15. At this time, the limit switch 22 is in the off state, and the electromagnetic valve 20 is maintained at the position a after being changed over thereto. The pilot port 5*b* is therefore in communication with the tank 9 via the return lines 16 and 17. The line length of the return lines 16 and 17 is smaller than that of the line formed by the return lines 16, 10 and 8 in the conventional manner, thereby resulting in the smaller resistance to an oil flow through return lines 16 and 17. Therefore, for the same reason as that described above with respect to the first embodiment, this circuit realizes a reduction in the fluid resistance of oil which is discharged from the pilot port 5*b* into the line 16 as the directional control valve 5 is changed from the neutral position to the position A by the oil output from the remote control valve 3 when the operation lever 1 is rapidly operated to the side R, thereby immediately changing the directional control valve 5 to the position A. As a result, the piston rod 7*a* of the hydraulic cylinder 7 retracts with improved response to the operation of the operation lever 1.

When the operation lever 1 is changed to the neutral under the condition where the directional control valve 5 is at the position A, the limit switch 21 is turned off and the electromagnetic valve 19 is changed to the position a. The pilot port 5*a* is thereby connected to the tank 9 via the return lines 15 and 19. The line length of the return lines 15 and 18 is smaller than that of the line formed by the return lines 15, 14 and 8 in the conventional manner, resulting in the smaller resistance to an oil flow through the return lines 15 and 18. Therefore, for the same reason as that described above with respect to the first embodiment, this circuit realizes a reduction in the fluid resistance of oil which is discharged from the pilot port 5*a* into the line 15 as the directional control valve 5 is changed from the position A to the neutral position by the oil output from the remote control valve 3 when the operation lever 1 is rapidly changed to the neutral position, thereby enabling the directional control valve 5 to be immediately changed to the neutral position in compliance with the rapid operation of the operation lever 1. Accordingly, the cylinder 7 that has been moved stops with improved response to the operation of neutralizing the operation lever 1. Also in the case of change-over of the operation lever 1 in the direction L, the circuit operates in the same manner.

In these two embodiments, when the directional control valve 5 is changed from the position A or C to the position B (neutral position) or when it is changed from the position B to the position A or C, pressurized oil in the line 15 or 16 is rapidly returned to the tank 9 via one of the quick discharge valves 50*a* and 50*b* or electromagnetic valves 19 and 20 without passing through the lines 14 and 8 or the lines 10 and 8. That is, the line length of the return line that connects the tank 9 and each of the pilot ports 5*a* and 5*b* can be reduced irrespective of the positional relationship between the remote control valves 3 and 11 and the directional control valve 5. Thus, the length of the return line can be reduced as compared with the conventional circuit, and the pressure drop of oil discharged from the pilot ports 5*a* or 5*b* in the return line in response to the change-over operation of the directional control valve 5 is thereby reduced, thus improving the change-over response of the directional control valve 5.

In the above description, the present invention is exemplified by a directional control valve which is changed over three positions by a hydraulic pilot pressure. However, the present invention can also be applied to a circuit for operating a directional control valve capable of changing between two positions by a hydraulic pilot pressure. In this case, only one pilot port is provided, and oil which is discharged from a pilot return port of the directional control valve 5 when this valve is changed over by the application of a pressure to the pilot port is ordinarily returned directly to the tank via a short return line. The line length can therefore be reduced irrespective of the positional relationship between the remote control valve and the directional control valve. In this case, in a conventional circuit also, there is no problem in terms of response even during change-over of the directional control valve from the neutral position to an operative position. On the other hand, during change-over of the directional control valve from an operative position to the neutral position, oil which is discharged from the pilot port of the directional control valve in response to the change-over operation thereof escapes through a line connecting the remote control valve and the pilot port and enters the tank via the remote control valve, in the case of the conventional circuit. There is therefore a problem in terms of response when the operation lever is rapidly changed from the operative position to the neutral position, as in the case of the above-described three position change-over type of directional control valve. In this context, it is possible to improve the change-over response of the directional control valve by providing, in the line between the remote control valve and the pilot port of the directional control valve, the above-described type of quick discharge valve or an electromagnetic valve capable of being changed over in the above-described manner.

Industrial Applicability

In the above description, the present invention is exemplified by the hydraulic pilot operation circuits in which the directional control valve for controlling the flow rate and the direction of supply of pressurized oil to a hydraulic cylinder is changed over in a remote control manner. However, the present invention can also be applied to a hydraulic pilot operation circuit in which various types of hydraulic control valve changed over in a remote control manner for controlling only the flow rate or direction of pressurized oil. In the present invention, hydraulic control valves may control the action of a different type of hydraulic actuator as well as a hydraulic cylinder. Also, the present invention is applicable to other various types of hydraulic pilot operation circuit including one which remote-controls a hydraulic control valve for controlling the tilting-rotation angle of a variable displacement hydraulic pump used in a closed circuit.

What is claimed is:

1. A hydraulic pilot operation circuit having a first pressure source connected to a hydraulic control valve located outside of a cabin of a construction machine and a second pressure source connected to a remote control valve disposed in the cabin of the construction machine and producing a hydraulic pilot pressure in proportion to an operation amount of said remote control valve, said hydraulic control valve being disposed between said first hydraulic pressure source and a hydraulic actuator and adapted to control the flow rate and the direction of oil supplied to said hydraulic actuator, said hydraulic control valve being changed over by said hydraulic pilot pressure supplied from said remote control valve through a pilot line to a pilot port of said hydraulic control valve, and wherein said pilot line has a length such that if the hydraulic pilot pressure produced by said remote control valve decreased to a tank pressure and acted directly upon said pilot port of said hydraulic control valve, the pressure at said pilot port will not immediately decrease to said tank pressure, said hydraulic pilot operation circuit comprising:

change-over means provided between an output port of said remote control valve and said pilot port of said hydraulic control valve, said change-over means connecting said hydraulic pilot pressure output from said output port of said remote control valve to said pilot port of said hydraulic control valve when said remote control valve is operated to an active position, and said change-over means connecting said pilot port to a tank when said remote control valve is operated to a neutral position.

2. A hydraulic pilot operation circuit according to claim 1, wherein said change-over means comprises an electromagnetic change-over valve which is changed over by an electromagnetic force;

said hydraulic pilot operation circuit includes a detection means for detecting said neutral state of said remote control valve as an electrical signal; and said electromagnetic change-over valve is changed over between a first position at which said change-over valve connects said output port of said remote control valve to said pilot port of said hydraulic control valve when said detection means does not detect the neutral position of said remote control valve and a second positions at which said change-over valve connects said pilot port to said tank when said detection means detects the neutral position of said remote control valve.

3. A hydraulic pilot operation circuit according to claim 2 wherein said hydraulic control valve comprises a three-position-changeover valve having a pair of pilot ports oppositely disposed; a pair of said remote control valves are connected to said pilot ports; a pair of said electromagnetic change-over valves are interposed between said pair of remote control valves and said pair of pilot ports.

4. A hydraulic pilot operation circuit according to claim 1 wherein said hydraulic control valve comprises a two-position-changeover valve having one pilot port; one remote control valve connected to said pilot port is provided; and said change over means is provided between said remote control valve and said pilot port.

5. A hydraulic pilot operation circuit according to claim 1 wherein said hydraulic control valve comprises a three-position-changeover valve having a pair of pilot ports oppositely disposed; a pair of said remote control valves are connected to said pair of pilot ports; said change-over means is interposed between each of said pair of remote control valves and a corresponding one of said pair of pilot ports.

6. A hydraulic pilot operation circuit in which a hydraulic control valve disposed between a hydraulic pressure source and a hydraulic actuator and adapted to control the flow rate and the direction of oil supplied to said hydraulic actuator is changed over by a hydraulic pilot pressure supplied from a remote control valve to a pilot port of said hydraulic control valve, said hydraulic pilot operation circuit comprising:

a hydraulic pressure quick discharge valve provided between an outlet port of said remote control valve and said pilot port of said hydraulic control valve, said hydraulic pressure quick discharge valve connecting said output port of said remote control valve to said pilot port of said hydraulic control valve when said remote control valve is operated, and said hydraulic pressure quick discharge valve connecting said pilot port of said hydraulic control valve to a tank when said remote control valve is operated to a neutral position, wherein said hydraulic pressure quick discharge valve comprises a hydraulic pilot pressure output from said remote control valve, said hydraulic pressure quick discharge valve having:

an inlet port supplied with the hydraulic pressure output from said output port of said remote control valve;

an outlet port through which a hydraulic pressure is output in proportion to said output hydraulic pressure at said inlet port;

a tank port in fluid communication with said tank;

a plunger capable of moving between a first position at which said plunger isolates said inlet port and said outlet port from each other and provides a communication between said outlet port and said tank port and a second position at which said plunger provides a communication between said inlet port and said outlet port and isolates and outlet port and said tank port from each other; and a resilience means for urging said plunger to be displaced toward said first position, wherein:

when said output hydraulic pressure prevailing over a force of said resilience means is supplied to said inlet port, said plunger is moved by said output hydraulic pressure to a third position, which is determined in accordance with said output hydraulic pressure, between said first and second positions, so that a hydraulic pressure lower than said hydraulic pressure output from said remote control valve by a value corresponding to said force o said resilience means is output from said outlet port; and, when said hydraulic pressure at said inlet port decreases and a difference between said hydraulic pressure at said inlet port and at said outlet port is less than said value corresponding to said force of said resilience means, said plunger is moved by said force of said resilience means to said first position, so that said outlet communicates with said tank port.

7. A hydraulic pilot operation circuit according to claim 6 wherein said hydraulic control valve comprises a three-position-changeover valve having a pair of pilot ports oppositely disposed; a pair of said remote control valves are connected to said pilot ports; a pair of said quick discharge valves are interposed between said pair of remote control valves and said pair of pilot ports.

8. A hydraulic pressure quick discharge valve comprising:

an inlet port supplied with an output hydraulic pressure;

an outlet port through which a hydraulic pressure is output in proportion to said output hydraulic pressure at said inlet port;

a tank port in fluid communication with a tank;

a plunger capable of moving between a first position at which said plunger isolates said inlet port and said outlet port from each other and provides a communication between said outlet port and said tank port and a second position at which said plunger provides a communication between said inlet port and said output port and isolates said outlet port and said tank port from each other; and a resilience means for urging said plunger to be displaced toward said first position, wherein:

when a hydraulic pressure prevailing over a force of said resilience means is supplied to said inlet port, said plunger is moved by said hydraulic pressure to a third position, which is determined in accordance with said hydraulic pressure, between said first and second positions, so that a hydraulic pressure lower than said hydraulic pressure supplied to said inlet port by a value corresponding to said force of said resilience means is output from said outlet port; said valve being lower than a maximum output hydraulic pressure supplied to said inlet port, and wherein when said hydraulic pressure at said inlet port decreases and a difference between said hydraulic pressure at said inlet port and at said outlet port is less than said value corresponding to said force of the resilience means, said plunger is located at said first position.

* * * * *